US010907294B2

(12) United States Patent
McAllister et al.

(10) Patent No.: US 10,907,294 B2
(45) **Date of Patent: *Feb. 2, 2021**

(54) LAUNDRY TREATING APPLIANCE AND INDICATING OPERATIONAL INFORMATION FOR A BULK DISPENSING SYSTEM

(71) Applicant: WHIRLPOOL CORPORATION, Benton Harbor, MI (US)

(72) Inventors: Karl David McAllister, Stevensville, MI (US); Michael T. Dalton, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 238 days.

This patent is subject to a terminal disclaimer.

(21) Appl. No.: 16/135,658

(22) Filed: Sep. 19, 2018

(65) Prior Publication Data

US 2019/0017214 A1 Jan. 17, 2019

Related U.S. Application Data

(60) Continuation of application No. 15/247,486, filed on Aug. 25, 2016, now Pat. No. 10,100,455, which is a (Continued)

(51) Int. Cl.
*D06F 39/02* (2006.01)
*D06F 33/00* (2020.01)
(Continued)

(52) U.S. Cl.
CPC ..... *D06F 39/022* (2013.01); *D06F 33/00* (2013.01); *D06F 33/37* (2020.02); *D06F 33/57* (2020.02);
(Continued)

(58) Field of Classification Search
CPC ..... D06F 33/00; D06F 39/02; D06F 39/022; D06F 39/005; D06F 33/37; D06F 33/57;
(Continued)

(56) References Cited

U.S. PATENT DOCUMENTS 2,816,427 A 12/1957 Vela
2,872,076 A 2/1959 Bloom
(Continued)

FOREIGN PATENT DOCUMENTS

CA 2027154 A1 4/1991
DE 8033429 U1 5/1982
(Continued)

OTHER PUBLICATIONS

German Search Report for Counterpart DE102009030288, dated Feb. 27, 2012.
(Continued)

*Primary Examiner* — Joseph L. Perrin
(74) *Attorney, Agent, or Firm* — McGarry Bair PC

(57) ABSTRACT

A laundry treating appliance having a treating chamber and a bulk dispenser and a user interface configured to provide an indication to the user related to the bulk chemistry dispenser and a controller coupled with the user interface and the bulk treating chemistry dispenser and configured to execute an operating cycle including controlling the treating chemistry meter to dispense the predetermined amount of treating chemistry and determine a number of doses of treating chemistry available in the bulk treating chemistry dispenser and method of determining the number of doses and the types of a treating chemistry available in the bulk dispensing system, and providing an indication of the determination on a user interface.

19 Claims, 3 Drawing Sheets

Related U.S. Application Data continuation of application No. 14/104,058, filed on Dec. 12, 2013, now Pat. No. 9,445,704, which is a division of application No. 13/608,162, filed on Sep. 10, 2012, now Pat. No. 8,615,834, which is a division of application No. 12/165,873, filed on Jul. 1, 2008, now Pat. No. 8,286,288.

(51) Int. Cl.

| | |
|---|---|
| ***D06F 34/28*** | (2020.01) |
| ***D06F 33/57*** | (2020.01) |
| ***D06F 33/37*** | (2020.01) |
| ***D06F 34/14*** | (2020.01) |
| *A47L 15/44* | (2006.01) |
| *A47L 15/00* | (2006.01) |

(52) U.S. Cl.

CPC ..... *D06F 34/14* (2020.02); *D06F 34/28* (2020.02); *D06F 39/02* (2013.01); *A47L 15/0055* (2013.01); *A47L 15/4454* (2013.01); *A47L 2301/023* (2013.01); *A47L 2301/026* (2013.01); *A47L 2301/04* (2013.01); *A47L 2401/023* (2013.01); *A47L 2401/026* (2013.01); *A47L 2401/22* (2013.01); *A47L 2501/26* (2013.01); *A47L 2501/265* (2013.01)

(58) Field of Classification Search

CPC ..... D06F 34/14; D06F 34/28; A47L 15/055; A47L 15/4454; A47L 2301/023; A47L 2301/026; A47L 2301/04; A47L 2401/023; A47L 2401/026; A47L 2401/22; A47L 2501/26; A47L 2501/265

See application file for complete search history.

(56) References Cited

U.S. PATENT DOCUMENTS

| | | | |
|---|---|---|---|
| 3,120,329 | A | 2/1964 | Noakes |
| 3,736,773 | A | 6/1973 | Waugh |
| 3,826,408 | A | 7/1974 | Berndt et al. |
| 3,848,436 | A | 11/1974 | Rottering |
| 3,848,437 | A | 11/1974 | Rottering |
| 3,850,185 | A | 11/1974 | Guth |
| 3,881,328 | A | 5/1975 | Kleimola et al. |
| 3,990,272 | A | 11/1976 | Gakhar |
| 4,009,598 | A | 3/1977 | Bernard et al. |
| 4,103,520 | A | 8/1978 | Jarvis et al. |
| 4,162,028 | A | 7/1979 | Reichenberger |
| 4,426,362 | A | 1/1984 | Copeland et al. |
| 4,569,781 | A | 2/1986 | Fernholz et al. |
| 4,580,721 | A | 4/1986 | Coffee et al. |
| 4,763,493 | A | 8/1988 | Nishite et al. |
| 4,763,494 | A | 8/1988 | der Kinderen |
| 4,790,981 | A | 12/1988 | Mayer et al. |
| 4,845,965 | A | 7/1989 | Copeland et al. |
| 4,862,711 | A | 9/1989 | Ikeda et al. |
| 4,875,607 | A | 10/1989 | Torita et al. |
| 5,014,211 | A | 5/1991 | Turner et al. |
| 5,063,757 | A | 11/1991 | Ikeda et al. |
| 5,088,621 | A | 2/1992 | Thompson et al. |
| 5,134,867 | A | 8/1992 | Kiuchi et al. |
| 5,186,912 | A | 2/1993 | Steindorf et al. |
| 5,195,338 | A | 3/1993 | Russo |
| 5,207,080 | A | 5/1993 | Reinhard |
| 5,234,615 | A | 8/1993 | Gladfelter et al. |
| 5,261,432 | A | 11/1993 | Sandrin |
| 5,316,688 | A | 5/1994 | Gladfelter et al. |
| 5,390,385 | A | 2/1995 | Beldham |
| 5,392,827 | A | 2/1995 | Yasso et al. |
| 5,417,233 | A | 5/1995 | Thomas et al. |
| 5,435,157 | A | 7/1995 | Laughlin |
| 5,606,877 | A | 3/1997 | Hashimoto |
| 5,636,763 | A | 6/1997 | Furness |
| 5,743,115 | A | 4/1998 | Hashimoto |
| 5,758,521 | A | 6/1998 | Roberts |
| 5,836,482 | A | 11/1998 | Ophardt et al. |
| 5,839,097 | A | 11/1998 | Klausner |
| 5,870,906 | A | 2/1999 | Denisar |
| 5,897,671 | A | 4/1999 | Newman et al. |
| 5,913,454 | A | 6/1999 | McHale |
| 5,992,685 | A | 11/1999 | Credle, Jr. |
| 6,007,788 | A | 12/1999 | Bellon et al. |
| 6,169,964 | B1 | 1/2001 | Aisa et al. |
| 6,227,012 | B1 | 5/2001 | Borroni et al. |
| 6,349,440 | B1 | 2/2002 | Amberg et al. |
| 6,401,499 | B1 | 6/2002 | Clark et al. |
| 6,434,977 | B1 | 8/2002 | Hapke et al. |
| 6,918,398 | B2 | 7/2005 | Edelmann et al. |
| 6,995,129 | B2 | 2/2006 | Olson et al. |
| 6,998,380 | B2 | 2/2006 | Fry et al. |
| 7,036,175 | B2 | 5/2006 | Sears et al. |
| 7,047,663 | B2 | 5/2006 | Zhang et al. |
| 7,059,065 | B2 | 6/2006 | Gerlach et al. |
| 7,066,412 | B2 | 6/2006 | Conley et al. |
| 7,177,712 | B2 | 2/2007 | Blair et al. |
| 7,250,086 | B2 | 7/2007 | Furber et al. |
| 7,275,552 | B2 | 10/2007 | DeWeerd et al. |
| 7,424,813 | B2 | 9/2008 | Wu |
| 7,464,718 | B2 | 12/2008 | McIntyre et al. |
| 7,578,150 | B2 | 8/2009 | Zsambeki |
| 7,658,088 | B2 | 2/2010 | Walker et al. |
| 7,725,970 | B2 | 6/2010 | Tuttle et al. |
| 7,950,088 | B2 | 5/2011 | Dalton et al. |
| 8,052,805 | B2 | 11/2011 | Hendrickson et al. |
| 8,122,743 | B2 | 2/2012 | Schulze |
| 8,196,441 | B2 | 6/2012 | Hendrickson et al. |
| 8,246,756 | B2 | 8/2012 | Hendrickson et al. |
| 8,382,913 | B2 | 2/2013 | Classen et al. |
| 8,397,544 | B2 | 3/2013 | Hendrickson |
| 8,438,881 | B2 | 5/2013 | Ihne et al. |
| 8,468,858 | B2 | 6/2013 | Hendrickson et al. |
| 8,505,341 | B2 | 8/2013 | Hendrickson et al. |
| 8,677,538 | B2 | 3/2014 | Hendrickson et al. |
| 8,713,737 | B2 | 5/2014 | Ihne et al. |
| 8,789,226 | B2 | 7/2014 | Dalton et al. |
| 9,074,312 | B2 | 7/2015 | D'Andrea et al. |
| 2001/0049846 | A1 | 12/2001 | Guzzi et al. |
| 2002/0040505 | A1 | 4/2002 | Tanaka et al. |
| 2002/0040506 | A1 | 4/2002 | Seagar et al. |
| 2002/0088502 | A1 | 7/2002 | Van Rompouy |
| 2003/0009428 | A1 | 1/2003 | Barbe |
| 2003/0010791 | A1 | 1/2003 | Gentiluomo et al. |
| 2003/0051513 | A1 | 3/2003 | Castelli et al. |
| 2003/0116177 | A1 | 6/2003 | Appel et al. |
| 2003/0154560 | A1 | 8/2003 | Behrens et al. |
| 2003/0213503 | A1 | 11/2003 | Price et al. |
| 2003/0233168 | A1 | 12/2003 | Perin, Jr. et al. |
| 2003/0233710 | A1 | 12/2003 | Classen |
| 2004/0005990 | A1 | 1/2004 | Aubay et al. |
| 2004/0010859 | A1 | 1/2004 | Aubay et al. |
| 2004/0082491 | A1 | 4/2004 | Olson et al. |
| 2004/0084065 | A1 | 5/2004 | Edelmann et al. |
| 2004/0098811 | A1 | 5/2004 | Tuttle et al. |
| 2004/0244434 | A1 | 12/2004 | Zucholl et al. |
| 2004/0244819 | A1 | 12/2004 | Edelmann et al. |
| 2005/0121058 | A1 | 6/2005 | Furber et al. |
| 2005/0126608 | A1 | 6/2005 | DeWeerd et al. |
| 2005/0229652 | A1 | 10/2005 | Kim et al. |
| 2006/0040845 | A1 | 2/2006 | Gladfelter et al. |
| 2006/0107705 | A1 | 5/2006 | Hsu et al. |
| 2006/0117811 | A1 | 6/2006 | Kinnetz |
| 2006/0150437 | A1 | 7/2006 | Tarnowski et al. |
| 2006/0196529 | A1 | 9/2006 | Kenowski et al. |
| 2006/0254626 | A1 | 11/2006 | Botts et al. |
| 2006/0270579 | A1 | 11/2006 | Aubay et al. |
| 2006/0272359 | A1 | 12/2006 | Kang |
| 2006/0272360 | A1 | 12/2006 | Hsu et al. |
| 2007/0022790 | A1 | 2/2007 | Slutsky et al. |
| 2007/0084253 | A1 | 4/2007 | Ehrlich et al. |
| 2007/0131000 | A1 | 6/2007 | Jeong |
| 2007/0163098 | A1 | 7/2007 | Tomasi et al. |
| 2007/0163307 | A1 | 7/2007 | Kramme et al. |

(56) References Cited

U.S. PATENT DOCUMENTS

| | | | |
|---|---|---|---|
| 2007/0261177 | A1 | 11/2007 | Risen et al. |
| 2008/0107576 | A1 | 5/2008 | Zettlitzer et al. |
| 2008/0276966 | A1 | 11/2008 | Yusuf et al. |
| 2009/0095028 | A1 | 4/2009 | Hoppe et al. |
| 2009/0095031 | A1 | 4/2009 | Favaro et al. |
| 2009/0100880 | A1 | 4/2009 | Hill |
| 2009/0100881 | A1 | 4/2009 | Dahlke |
| 2009/0158782 | A1 | 6/2009 | Hill |
| 2009/0235962 | A1 | 9/2009 | Classen et al. |
| 2009/0293202 | A1 | 12/2009 | Bolduan et al. |
| 2009/0308111 | A1 | 12/2009 | Robb et al. |
| 2010/0000264 | A1 | 1/2010 | Luckman et al. |
| 2010/0000580 | A1 | 1/2010 | Classen et al. |
| 2010/0040213 | A1 | 2/2010 | Park et al. |
| 2010/0115708 | A1 | 5/2010 | Caswell et al. |
| 2010/0300157 | A1 | 12/2010 | Schulze |
| 2011/0017239 | A1 | 1/2011 | VanLoyen et al. |

FOREIGN PATENT DOCUMENTS

| | | | |
|---|---|---|---|
| DE | 3403622 | A1 | 8/1985 |
| DE | 3403852 | A1 | 8/1985 |
| DE | 3833961 | A1 | 4/1990 |
| DE | 3908438 | A1 | 9/1990 |
| DE | 4014776 | A1 | 11/1991 |
| DE | 4017001 | A1 | 11/1991 |
| DE | 69019666 | T2 | 10/1995 |
| DE | 19619602 | A1 | 11/1997 |
| DE | 19902974 | A1 | 10/1999 |
| DE | 20115173 | U1 | 11/2001 |
| DE | 10144667 | A1 | 3/2003 |
| DE | 10334283 | A1 | 12/2004 |
| DE | 102006043913 | A1 | 3/2008 |
| DE | 102007023065 | A1 | 11/2008 |
| DE | 102009030288 | A1 | 1/2010 |
| DE | 102009030290 | A1 | 1/2010 |
| DE | 102009030329 | A1 | 1/2010 |
| EP | 0169604 | A2 | 1/1986 |
| EP | 423044 | A1 | 4/1991 |
| EP | 0611159 | A1 | 8/1994 |
| EP | 0685587 | A1 | 12/1995 |
| EP | 1063340 | A1 | 12/2000 |
| EP | 1637060 | A2 | 3/2006 |
| EP | 1731654 | A1 | 12/2006 |
| EP | 1808520 | A1 | 7/2007 |
| EP | 1842953 | A2 | 10/2007 |
| EP | 1849909 | A1 | 10/2007 |
| EP | 1884584 | A2 | 2/2008 |
| EP | 2003237 | A1 | 12/2008 |
| EP | 2141276 | A1 | 1/2010 |
| EP | 2324151 | B1 | 12/2011 |
| EP | 2518204 | A1 | 10/2012 |
| EP | 2342377 | B1 | 1/2015 |
| GB | 2015870 | A | 9/1979 |
| GB | 2134078 | A | 8/1984 |
| GB | 2136831 | A | 9/1984 |
| GB | 2214524 | A | 9/1989 |
| GB | 2311767 | A | 10/1997 |
| GB | 2386130 | A | 9/2003 |
| GB | 2417492 | A | 3/2006 |
| IT | TO20060569 | A1 | 2/2008 |
| JP | 03191994 | A | 8/1991 |
| JP | 11309296 | A | 11/1999 |
| WO | 8806199 | A1 | 8/1988 |
| WO | 0220893 | A1 | 3/2002 |
| WO | 02058528 | A1 | 8/2002 |
| WO | 2003027377 | A1 | 4/2003 |
| WO | 03102291 | A1 | 12/2003 |
| WO | 2006010924 | A1 | 2/2006 |
| WO | 2006021760 | A1 | 3/2006 |
| WO | 2006037354 | A1 | 4/2006 |
| WO | 2006042631 | A1 | 4/2006 |
| WO | 2006061041 | A1 | 6/2006 |
| WO | 2006094219 | A1 | 9/2006 |
| WO | 2006098571 | A1 | 9/2006 |
| WO | 2007056097 | A2 | 5/2007 |
| WO | 2008034691 | A1 | 3/2008 |
| WO | 2008034965 | A1 | 3/2008 |
| WO | 2008053183 | A1 | 5/2008 |
| WO | 2008138798 | A2 | 11/2008 |
| WO | 2008155264 | A1 | 12/2008 |
| WO | 10010433 | A2 | 1/2010 |

OTHER PUBLICATIONS

German Search Report for Counterpart DE102009030289, dated Feb. 11, 2014.

German Search Report for Counterpart DE102009030329, dated Feb. 7, 2014.

LAUNDRY TREATING APPLIANCE AND INDICATING OPERATIONAL INFORMATION FOR A BULK DISPENSING SYSTEM

CROSS-REFERENCE TO RELATED APPLICATIONS

The present application is a continuation of U.S. patent application Ser. No. 15/247,486, filed Aug. 25, 2016, now U.S. Pat. No. 10,100,455, issued Oct. 16, 2018, which application is a continuation of U.S. patent application Ser. No. 14/104,058, filed Dec. 12, 2013, now U.S. Pat. No. 9,445,704, issued Sep. 20, 2016, which application is a divisional application of U.S. patent application Ser. No. 13/608,162, filed Sep. 10, 2012, now U.S. Pat. No. 8,615,834, issued Dec. 31, 2013, which application is a divisional of U.S. patent application Ser. No. 12/165,873, filed Jul. 1, 2008, now U.S. Pat. No. 8,286,288, issued Oct. 16, 2012, all of which are incorporated herein by reference in their entirety.

BACKGROUND

Cleaning appliances, such as dishwashers or clothes washers, are often provided with a dispensing system for automatically dispensing one or more treating chemistries during a cleaning cycle. One common type of dispenser is the manual or single use dispenser, which may be filled with a dose of treating chemistry sufficient for a single cleaning cycle. Another type of dispenser is a bulk dispenser, which contains an amount of treating chemistry sufficient for multiple cleaning cycles. The bulk dispensing systems, while known, are not very common in household appliances. Some systems are capable of controlling and varying the amount of treating chemistry. These systems are more convenient to the user in the sense that the user only has to remember to fill them once every few cycles of operation.

BRIEF DESCRIPTION

An aspect of the present disclosure relates to a laundry treating appliance, comprising a laundry treating chamber, a bulk treating chemistry dispenser configured to hold multiple doses of treating chemistry for dispensing into the laundry treating chamber, a treating chemistry meter configured to dispense a predetermined amount of treating chemistry from the bulk treating chemistry dispenser, a user interface configured to provide an indication to the user related to the bulk chemistry dispenser, and a controller coupled with the user interface and the bulk treating chemistry dispenser and configured to execute an operating cycle including controlling the treating chemistry meter to dispense the predetermined amount of treating chemistry and determine a number of doses of treating chemistry available in the bulk treating chemistry dispenser.

DETAILED DESCRIPTION

Figure 1:
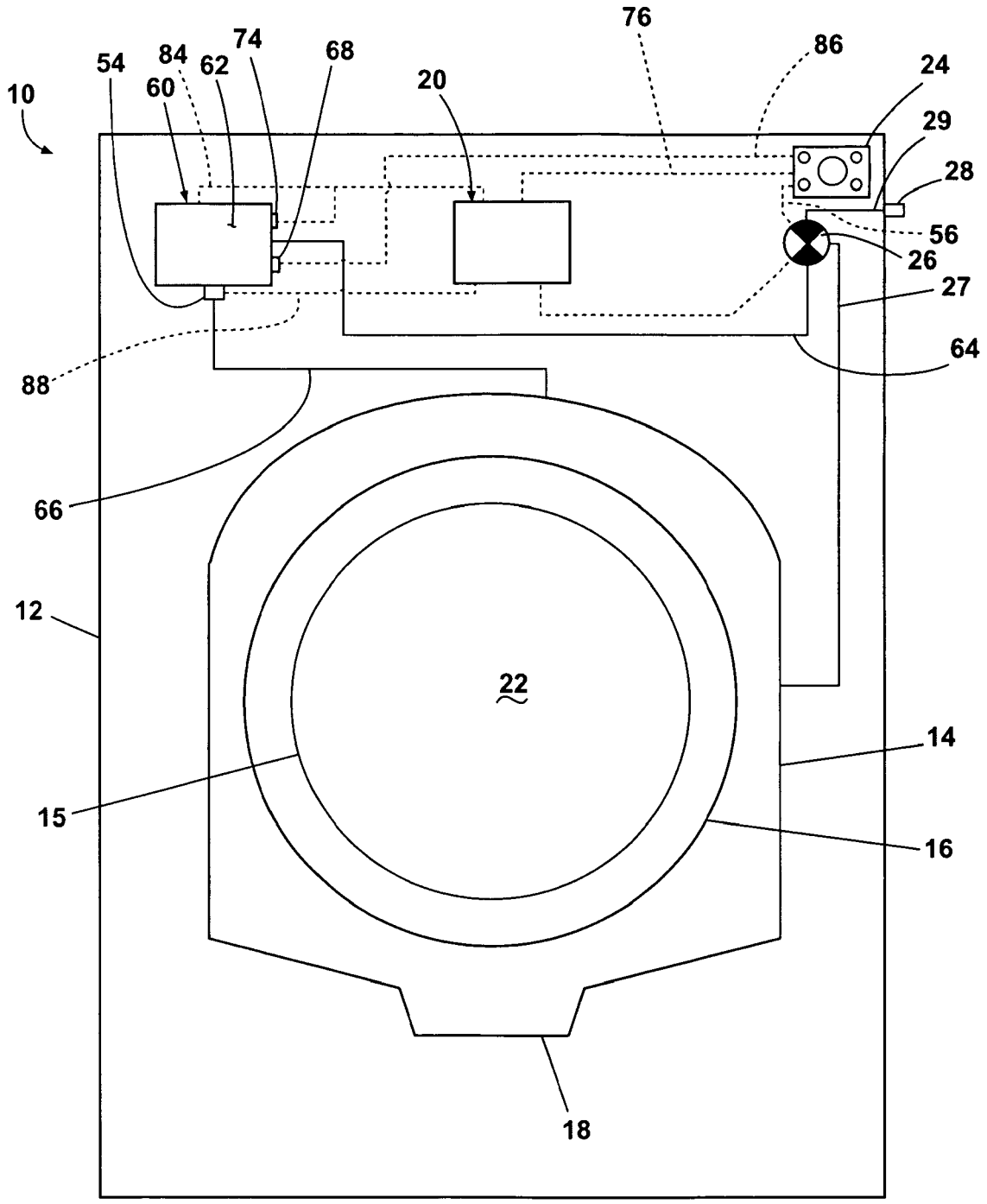
FIG. 1 is a schematic view of an automatic clothes washing machine having a dispensing system and user interface according to an embodiment of the invention.

FIG. 1 illustrates a household cleaning appliance in which one method embodying the invention may be implemented. The cleaning appliance is shown in the environment of a horizontal axis automatic clothes washing machine 10. Although much of the remainder of this application will focus on the embodiment of an automatic clothes washing machine, the invention may have utility in other environments, including other cleaning appliances, such as dryers, combination washer-dryers, fabric fresheners, and dishwashers, or other non-cleaning appliances such as refrigerators. The automatic clothes washing machine 10 shares many features of a conventional automated clothes washer, which will not be described in detail herein except as necessary for a complete understanding of the invention.

Further, washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. However, the rotational axis need not be vertical. The drum may rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum may rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, typically a fabric moving element moves within a drum to impart mechanical energy directly to the clothes or indirectly through wash liquid in the drum. In horizontal axis machines mechanical energy is typically imparted to the clothes by the tumbling action formed by the repeated lifting and dropping of the clothes, which is typically implemented by the rotating drum, although horizontal axis machines could also include fabric moving elements.

While technology and methods are not always interchangeable between vertical and horizontal axis machines, the invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 enclosing components typically found in a conventional washing machine, such as motors, pumps, fluid lines, controls, sensors, transducers, and the like. A door 15 may be mounted to the cabinet to selectively close an access opening to the interior of a tub 14 that defines a wash chamber 22 in which fabric articles, collectively forming a load of laundry, are treated. Both the tub 14 and a drum 16 are suspended in the interior of the cabinet 12. The tub 14 may be associated with a sump 18 for temporarily holding a liquid used during a cleaning cycle. The liquid may be only water or may be a mixture of water and a treating chemistry, such as a detergent. Other treating chemistries, such as bleach or softener, may also be in the mixture.

The cabinet 12 may include a user interface 20 that has operational controls such as dials, lights, switches, and displays enabling a user to input commands to a controller 24 and receive information about a specific cleaning cycle. The user interface 20 may be electrically coupled with the controller 24 through user interface leads 76. When the controller 24 is a microprocessor controller, the various cleaning cycles capable of being implemented by the controller 24 may be stored in internal memory of the controller 24 or memory associated with the controller 24. These cycles may be any desired cycle, including all currently known cycles.

With respect to a washing machine, the term cleaning cycle may be used to mean one operational cycle of the automatic clothes washing machine 10 that cleans a laundry load having one or more articles. The term cleaning cycle is not limited to a wash cycle in the traditional sense where laundry is washed in a water and detergent solution. The term cleaning cycle may include applying a treating chemistry to the laundry, or to a treating cycle in combination with or part of a traditional cleaning cycle.

A multi-use or bulk dispensing system 60 may also be located in the cabinet 12 and may dispense treating chemistry during a cleaning cycle. The treating chemistry may be any type of aid for treating fabric, and examples may include, but are not limited to washing aids, such as detergents and oxidizers, including bleaches, and additives, such as fabric softeners, sanitizers, de-wrinklers, and chemicals for imparting desired properties to the fabric, including stain resistance, fragrance (e.g., perfumes), insect repellency, and UV protection.

As used herein, the term multiple doses of treating chemistry, and variations thereof, refers to an amount of treating chemistry sufficient for multiple cleaning cycles of the automatic clothes washing machine.

Looking at the components of the washing machine in greater detail, the controller 24 may be operably coupled to the bulk dispensing system 60. In this way, the controller 24 may control the selective dispensing of treating chemistry to the wash chamber 22 during the cleaning cycle from the bulk dispensing system 60.

The water control system may also include a conduit 29 fluidly coupling a control valve 26 to a household water supply 28. The valve 26 is fluidly coupled to the tub 14 and bulk dispensing system 60 by dispensing lines 27 and 64, respectively. In this way, the valve 26 may be used to control the selective distribution of the household water supply to the water-using components of the washing machine 10.

A dispensing line 66 may fluidly couple the bulk dispensing system 60 with the tub 14. Thus, fresh water may be delivered from the water supply 28 through the conduit 29, valve 26 and to dispensing line 64 into the bulk dispensing system 60 for flushing treating chemistry there from and to the tub through the dispensing line 66. The valve 26 may be electrically coupled with the controller 24 through a valve control lead 56. The controller 24 may control the operation of the valve 26 in response to instructions received from the user interface 20 as a result of selections made by the user, such as cleaning cycle, water temperature, spin speed, extra rinse, and the like.

The bulk dispensing system 60 may include at least one bulk dispensing chamber 62 that is sized to store multiple doses of treating chemistry that may be selectively dispensed into the tub 14 or the wash chamber 22 as part of the execution of the cleaning cycle. The bulk dispensing chamber 62 may further be provided with one or more sensors 68 that may be used to provide information about the status of the bulk dispensing system, such as: type of treating chemistry, amount of treating chemistry, and amount dosed, for example. The sensor 68 may be in communication with the controller 24 via a lead 86. The controller 24 may use the information to control a wash cycle or to display the information on the user interface 20. For example, if the sensor 68 is a fill indicator used to determine the amount of treating chemistry in the chamber 62, the controller may display this information on the user interface 20 for viewing by the consumer.

The fill indicator 68 may be any suitable type of sensor. It may be a direct sensor or an indirect sensor. A direct sensor will provide an output, such as a signal, that is indicative of the desired sensed condition. An indirect sensor will provide an output, such as a signal that is further processed, such as by the controller 24, to make a final determination for the desired sensed condition. In the case of a fill indicator 68, it may be an indirect sensor that provides a signal indicative of a volume level that the controller 24 uses to determine how full is the treating chemistry chamber. The sensor may also be a float-type indicator, a light-type indicator, or an alarm-type indicator. The fill indicator 68 may be any combination of visible or audible indication. The manner in which the sensing is accomplished is not germane to the invention and may include such methods as resistive, inductance or capacitance sensing.

The bulk dispensing chamber 62 may also include a sensor 74 indicating the presence of treating chemistry in the bulk dispensing chamber 62. The sensor 74 may be used to determine whether treating chemistry is or is not present in the bulk dispensing chamber 62, while the fill indicator 68 may be used to determine the amount of treating chemistry in the chamber 62. Multiple sensors 74 may indicate the presence of treating chemistry in multiple chambers within the dispensing chamber 62. The sensor 74 may be any suitable type of sensor, such as a pressure sensor, level sensor, or proximity sensor, for sensing the presence of treating chemistry in the dispensing chamber 62. Regardless of the type, the sensor 74 may send a signal to the controller 24, via the user interface 20, through lead 84 to indicate the presence of the treating chemistry in the dispensing chamber 62. The foregoing description may be of an exemplary sensor location; other locations may be utilized for the sensor 74.

The bulk dispensing system 60 may further include a treating chemistry meter 54 to dispense a predetermined amount of treating chemistry each cleaning cycle. The predetermined amount may vary from cycle-to-cycle, even for the same cycle, and will typically be set by the controller 24. The treating chemistry meter 54 may be a mechanical flow meter, a magnetic flow meter, or any other meter suitable for measuring liquid flow, all well known in the cleaning appliance art. The treating chemistry meter 54 may send a signal to the user interface 20 through lead 88 that is indicative of or used to determine the amount of treating chemistry that has been dispensed to the wash chamber 22.

While not illustrated, the bulk dispensing system 60 is capable of receiving and containing multiple types of treating chemistry in multiple chambers within the dispensing chamber 62. Each chamber may hold the chemistry or a removable container, such as a cartridge, containing the treating chemistry. Although the bulk dispenser cartridge has been illustrated or described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

Regardless of whether one or more treating chemistries are stored in the bulk dispensing system 60, the controller 24 may recognize the type of treating chemistry present in the dispensing chamber 62 through several methods. Examples of these recognition methods include, but are not limited to, user input, utilizing a keyed treating chemistry cartridge or cartridge with a RFID (radio-frequency identification) tag or chip, or sensors 74, such as refractive incidence sensors, to sense the type of chemistry. These methods may communicate to the controller 24 which of the various treating chemistries have been inserted into the dispensing chamber 62. The determined types of treating chemistry may be communicated to the controller 24 via lead 84, for display on the user interface 20.

Figure 2:
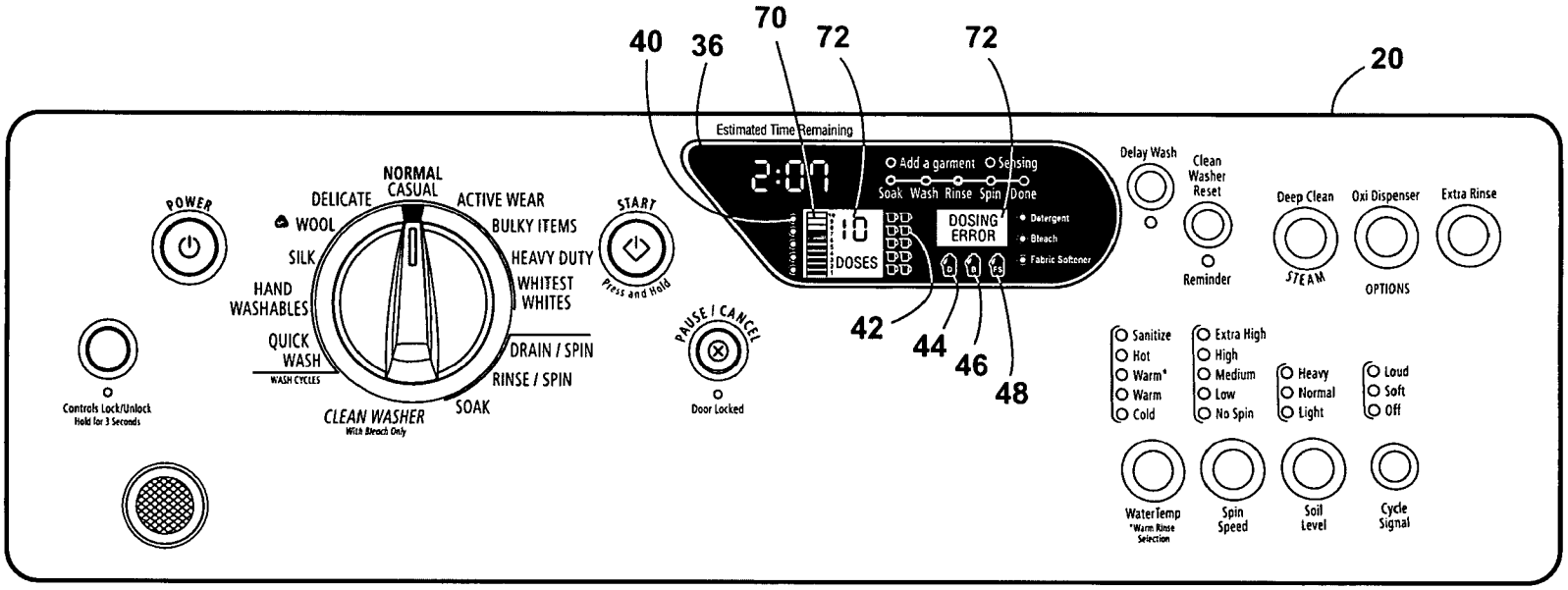
FIG. 2 is a detail view of the user interface of the cleaning appliance of FIG. 1 according to one embodiment of the invention.

Referring to FIG. 2, a detail view of the user interface 20 according to one implementation of the invention is shown. The user interface 20 may have a combination of operational controls such as dials, lights, switches, buttons, and displays enabling a user to input commands to a controller 24 and to receive information about a specific cleaning cycle. The user interface, as described here, is not limited to a visual display, but also includes communication to and from the user such as an audible indicator, a microphone, or a camera for example. Also, the term display should not be limited to a visual indicator, but should be defined to also include an audible indicator.

The user interface 20 may include the user inputted selection of fabric type, water temperature, spin speed, and wash delay, soil level, and cycle signal. The user interface 20, according to one implementation of the invention, further includes an indication of the determination of the number of doses of treating chemistry available in the bulk dispensing system 60 for supplying the operation of the cleaning cycle. Given this determination, an indication is provided on the user interface 20. This indication may be displayed as a visual indicator, an audible indicator, or both.

In an exemplary implementation, a remaining number of doses of treating chemistry in the bulk dispenser 60 may be determined by the controller 24 based on a reference dose size and a determined amount of treating chemistry present in the dispensing chamber 62. The reference dose size may be a standard dose size as determined by the manufacturer and inputted into the controller 24, or may be based on historical usage data for the washing machine 10. As described above, the historical usage data may be provided to the controller 24 by the treating chemistry meter 54, which may determine the amount of treating chemistry that has been dispensed to the wash chamber 22. This historical usage data may be stored in internal memory of the controller 24 or memory associated with the controller 24. For example, the meter 54 may be a mechanical type flow meter that has a component that rotates within a chamber of known volume. For each rotation, an amount of water passes through the chamber. A gear or magnetic drive counts the number of turns and sends a signal to the controller 24, which keeps a running total of the volume that has been recorded to have passed through the meter 54. This volume relates to a dose size, which may be compared to the set dose size, and then stored in the controller's 24 memory as the historical usage data.

The historical usage data may be any usage data that is indicative of dose size, examples of which include executed cycles and/or actual dose size. For example, different cycles may have different dose sizes. That is, a cycle for a large load may have a different dose requirement than a dose for a cycle for a small load. The historical cycle data may be analyzed to track the most commonly executed cycle and use the corresponding dose size as the reference dose. Alternatively, the reference dose size may be a weighted average of the dose size for the executed cycles. Yet another alternative is to use the dose size for the last executed cycle as the reference dose size or to use the dose size for the currently selected cycle as the reference dose size.

In a similar way, the actual dose size may be analyzed over time to set the reference dose size. For example, the actual dose data may be analyzed for the most common dose size and select that as a reference dose size. An average dose size may be determined and used as the reference dose size. The dose size of the last cycle or the current cycle may also be used as the reference dose size.

When an average dose size is used, it may be determined in a number of different ways. For example, it may be determined as a running average over the entire length of the washing machine's 10 life cycle, or may be based on a predetermined number of recent cycles, for example a calculated average dosage size over the last ten cycles.

Regardless of how the reference dose size is determined, the number of doses remaining may be determined by dividing the remaining treating chemistry by the reference dose size. The amount of treating chemistry sensed to be present in the dispensing chamber 62 may be directly determined by the sensor 68, which may be a fill indicator. With the above information, the sensed amount of treating chemistry may be compared to the reference dose size to determine a remaining number of doses present in the dispensing chamber 62.

Other alternatives for determining the remaining doses are possible and the invention is not limited to the particular method in which the reference dose size is determined. For example, it is not necessary to use a reference dose size. One such method would include determining or assuming that a set number of doses for the bulk dispensing system and then decrementing the set number of doses for each executed cycle until the bulk dispensing system is refilled. The amount decremented may be assumed to be one per cycle or it may be determined in one of the ways previously described. Again, the manner in which the remaining doses are determined is not limiting to the invention.

Figure 2A:
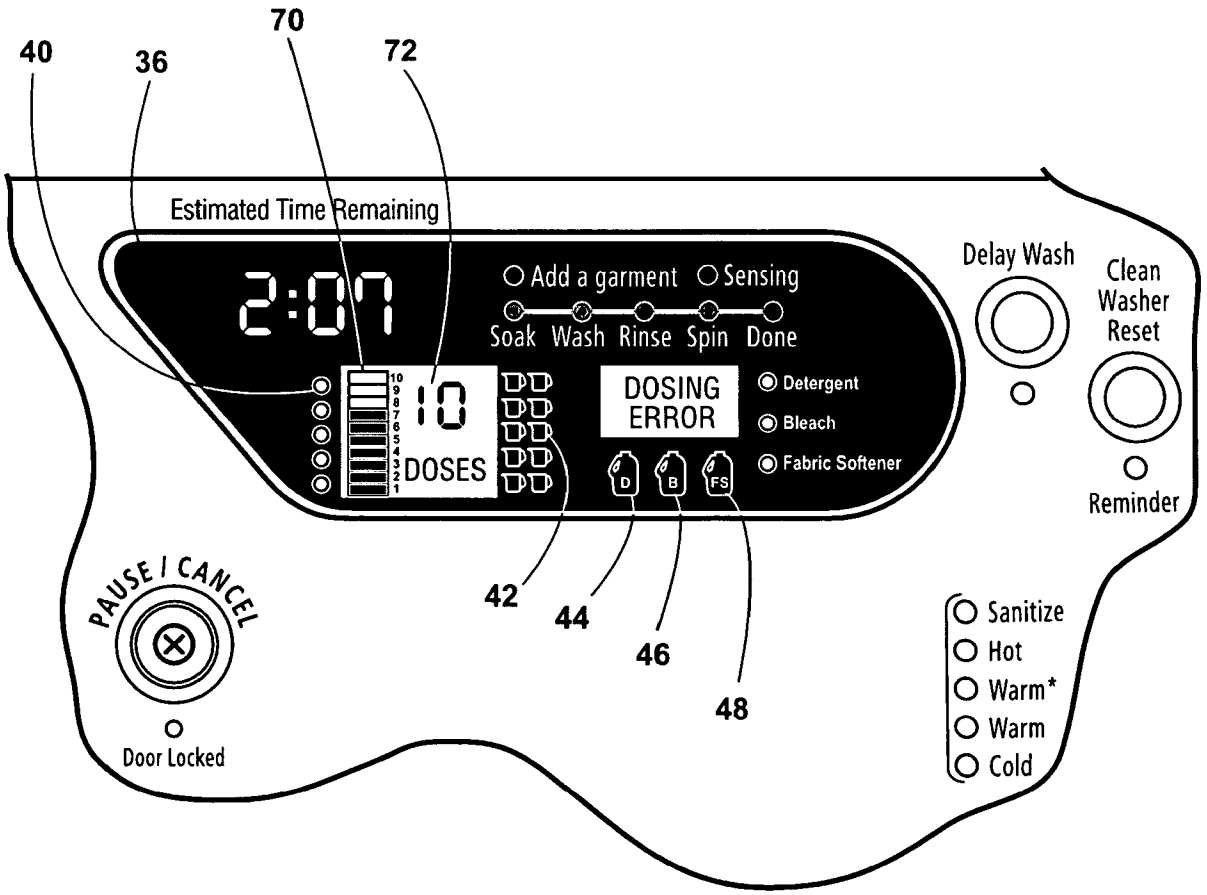
FIG. 2A is a detail view of the user interface illustrated in FIG. 2 according to one embodiment of the invention.

As shown in FIG. 2A, the determination of the remaining number of doses may be displayed on the user interface 20 by means of a series of icons 42; an alpha-numeric 72 reading on an LCD screen 36, or similar; a bar 70 reading to be proportionally illuminated; or a stack of lights 40 to be proportionally illuminated. This information is provided to the user interface 20 for display via the lead 76, as determined by the controller 24.

Further, the determination of the remaining number of doses may be displayed on the user interface 20 when the appliance is powered on. The particular method, as described above, for determining the reference dose size will have been established within the controller 24 and the user interface 20 may display the according number of doses remaining at the time the appliance is powered on. If the chosen method for determining the reference dose size is based on the dose size of the current cycle, the determination of the remaining number of doses may be displayed on the user interface 20 at the time the user selects the dose size for the current cycle.

In addition to displaying the remaining doses, the types of treating chemistries may also be displayed. For example, an alpha-numeric 72 character of each wash type to be displayed on the LCD screen 36, or similar. Alternatively, an iconic representation 44, 46, 48 of each of the types of treating chemistry may be displayed. Exemplary icons are shown in FIG. 2A.

Further, the user interface 20 may also display the status of the dosing operation of the bulk dispensing system 60 by providing an indication if the treating chemistry was determined not to have dispensed. During operation, it may be that the treating chemistry may not be dispensed for several reasons; for example, an absence of treating chemistry in the dispensing chamber 62, or a determined insufficient amount of treating chemistry present in the dispensing chamber 62 for the selected cycle. The absence of treating chemistry, or the determination that there is an insufficient amount present in the dispensing chamber may by made by the sensor 68, as described above. In the case that an insufficient amount of a particular treating chemistry is determined to be present, the controller 24 will effect the dispensing of the entire content of that particular chemistry. The determination that the treating chemistry was not dispensed is provided to the user interface 20 for display via the lead 88, as monitored throughout the cycle of operation by the sensor 68 and the treating chemistry meter 54.

An indication that the treating chemistry was not dispensed may be displayed on the user interface 20 by means such as an alpha-numeric 72 character to be displayed on the LCD screen 36, or similar. An exemplary alpha-numeric 72 character is the phrase "dosing error", which may be displayed in the dosing information area on the user interface 20. Alternatively, an iconic representation 44, 46, 48 of each of the types of treating chemistry may be displayed, and may flash or blink to indicate an error status, for example.

Dependent on the particular cycle that the user selects prior to operation of the washing machine 10, one or more treating chemistries or combinations thereof may be required. The bulk dispensing system 60 is capable of dispensing the type or types of treating chemistry required for the different cycles of operation as selected by the user. The user interface 20 may display the determination of which of the types of treating chemistry are required for the selected cycle of operation. This determination is provided by the controller 24 to the user interface 20 for display via the lead 76. The required treating chemistries may be displayed by means of an alpha-numeric 72 reading on an LCD screen 36, or similar; or a representative icon 44, 46, or 48. For example, an alpha-numeric 72 indication, such as the word "detergent", "bleach" or "fabric softener" may be displayed in the dosage information area on the user interface 20. Alternatively, each treating chemistry icon 44, 46, 48 may be displayed in the dosage information area on the user interface 20. Further, the appropriate alpha-numeric 72 character or icon 44, 46, 48 may be displayed at the time in the cycle of operation at which that particular chemistry is being dosed. The dosing information may be monitored by the sensor 68 or the treating chemistry meter 54. Optionally, the alpha-numeric 72 character or icon 44, 46, 48 may remain illuminated throughout the entire dispensing operation for that particular treating chemistry.

The method of the present invention offers many benefits to consumers, including feedback regarding the operation of the unit. The bulk dispensing system 60 eliminates the need for the user to remove a supply of treating chemistry from a storage space, fill a dispenser, and replace the supply of treating chemistry each time the washing machine 10 is operated. However, there may be some ambiguity inherent to a dispensing system providing for multiple cycles of operation and multiple treating chemistries. The described method and user interface 20 may eliminate that ambiguity by providing clear communication to the user regarding aspects of operation, such as the number of doses of treating chemistry remaining in the bulk dispenser and information regarding the type of treating chemistry being dosed.

The method of the present invention has been described thus far as relating primarily to a dose size and a reference dose size. However, another contemplated methodology of the invention may be related instead to volume. Like the method of determining and displaying the remaining number of doses, the remaining volume may be determined and displayed. This may be accomplished in several different ways.

One way in which the method of the present invention may relate to a volume instead of a dose size is by utilizing the above described level sensor. Given a known volume of the dispensing chamber 62, the level sensor may sense the level at which the treating chemistry fills the dispensing chamber 62 and provide that information to the controller 24. The provided information from the level sensor may be an absolute value, a percentage of the total volume of the dispensing chamber 62, or any other representative value. This provided information may be used by the controller 24 to determine the remaining volume of treating chemistry present in the bulk dispensing system 60.

Given this determination, an indication may be provided on the user interface 20. As described above with regard to doses remaining, this indication may be displayed as a visual indicator, an audible indicator, or both. The indication may be displayed as a volumetric value, such as cups, ounces, milliliters, or equivalent. Further, the determination of the remaining volume may be displayed on the user interface 20 by means of a series of icons 42; an alpha-numeric 72 reading on an LCD screen 36, or similar; a bar 70 reading to be proportionally illuminated; or a stack of lights 40 to be proportionally illuminated.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a laundry treating chamber;

a bulk treating chemistry dispenser configured to hold multiple doses of treating chemistry for dispensing into the laundry treating chamber;

a treating chemistry meter configured to dispense a predetermined amount of treating chemistry from the bulk treating chemistry dispenser;

a sensor adjacent to the bulk treating chemistry dispenser and where the sensor is configured to sense at least one of a presence of the treating chemistry, a presence of the bulk treating chemistry dispenser, a fill level of the treating chemistry in the bulk treating chemistry dispenser, or a volume of the treating chemistry in the bulk treating chemistry dispenser and provide an output signal indicative thereof; and a controller operably coupled with the sensor and the bulk treating chemistry dispenser and configured to execute an operating cycle including controlling the treating chemistry meter to dispense a predetermined amount of treating chemistry and determine a number of doses of treating chemistry available in the bulk treating chemistry dispenser based on information received from the sensor and the treating chemistry meter.

2. The laundry treating appliance of claim 1 wherein the predetermined amount of treating chemistry set to be dispensed by the controller varies from operating cycle to operating cycle.

3. The laundry treating appliance of claim 1 wherein the predetermined amount of treating chemistry set to be dispensed by the controller varies for a same type of operating cycle.

4. The laundry treating appliance of claim 1, further comprising a user interface configured to provide an indication to the user related to the bulk chemistry dispenser and wherein the treating chemistry meter is operably coupled to the user interface and is configured to send a signal to the user interface indicative of the amount of treating chemistry available or used.

5. The laundry treating appliance of claim 1, further comprising a user interface configured to provide an indication to the user related to the bulk chemistry dispenser and wherein the controller is configured to control the user interface such that the indication on the user interface relates to the determined number of doses of treating chemistry available in the bulk treating chemistry dispenser.

6. The laundry treating appliance of claim 5 wherein the indication of the number of doses of treating chemistry available in the bulk treating chemistry dispenser is an indication of a number of doses of treating chemistry remaining in the bulk treating chemistry dispenser, each dose being an average dose size.

7. The laundry treating appliance of claim 6 wherein the controller is further configured to determine the average dose size based on information output from the treating chemistry meter.

8. The laundry treating appliance of claim 7 wherein the controller is further configured to determine the average dose size from a running average of dispensed doses over a predetermined number of recent cycles.

9. The laundry treating appliance of claim 7 wherein the controller is further configured to determine the amount of treating chemistry remaining in the bulk treating chemistry dispenser based at least on a sensed presence of the treating chemistry and configured to determine the amount of treating chemistry by decrementing a predetermined number of doses for each executed cycle.

10. The laundry treating appliance of claim 1 wherein the controller is further configured to determine the number of doses of treating chemistry available in the bulk treating chemistry dispenser by dividing the sensed remaining treating chemistry by a reference dose size.

11. The laundry treating appliance of claim 10 wherein the treating chemistry meter provides historical usage data to the controller to define the reference dose size.

12. The laundry treating appliance of claim 1 wherein the controller is further configured to control execution of the operating cycle based on the number of doses of treating chemistry available in the bulk treating chemistry dispenser.

13. The laundry treating appliance of claim 12 wherein the controller is further configured to cease executing the operating cycle based on the number of doses of treating chemistry available in the bulk treating chemistry dispenser.

14. The laundry treating appliance of claim 1, further comprising a user interface configured to provide an indication to the user related to the bulk chemistry dispenser and wherein the user interface provides an indication of the determined number of doses of treating chemistry available in the bulk treating chemistry dispenser.

15. The laundry treating appliance of claim 14 wherein the user interface provides an iconic representation of the number of doses of treating chemistry available in the bulk treating chemistry dispenser.

16. The laundry treating appliance of claim 15 wherein the iconic representation of the number of doses of treating chemistry available in the bulk treating chemistry dispenser is at least one of an icon, an alpha-numeric reading, a bar reading to be proportionally illuminated, or a stack of lights to be proportionally illuminated.

17. The laundry treating appliance of claim 1 wherein the controller is further configured to determine that there is an insufficient amount of treating chemistry present in the bulk treating chemistry dispenser for a selected cycle.

18. The laundry treating appliance of claim 17 wherein the controller is further configured to effect the dispensing of entire contents of the bulk treating chemistry dispenser when it is determined that there is an insufficient amount of treating chemistry.

19. The laundry treating appliance of claim 18, further comprising a user interface configured to provide an indication to the user related to the bulk chemistry dispenser and wherein the controller is further configured to control the user interface such that the user interface provides an indication of the determined insufficient amount.

* * * * *